US007971735B2

(12) United States Patent
Mueller et al.

(10) Patent No.: US 7,971,735 B2
(45) Date of Patent: Jul. 5, 2011

(54) MERCHANDISING SYSTEM

(75) Inventors: Paul A. Mueller, Wadsworth, OH (US); John Caterinacci, Hudson, OH (US)

(73) Assignee: Fasteners For Retail, Inc., Cleveland, OH (US)

( * ) Notice: Subject to any disclaimer, the term of this patent is extended or adjusted under 35 U.S.C. 154(b) by 986 days.

(21) Appl. No.: 11/356,398

(22) Filed: Feb. 16, 2006

(65) Prior Publication Data

US 2007/0187344 A1 Aug. 16, 2007

(51) Int. Cl.
*A47F 1/04* (2006.01)

(52) U.S. Cl. ..... 211/59.3

(58) Field of Classification Search ..... 211/59.2, 211/59.3, 184, 189, 175, 183; 312/61, 71; 221/227, 255, 279
See application file for complete search history.

(56) References Cited

U.S. PATENT DOCUMENTS

| | | | |
|---|---|---|---|
| 1,971,749 | A | 8/1934 | Hamilton |
| 2,079,754 | A | 5/1937 | Waxgiser |
| 2,652,154 | A | 9/1953 | Stevens |
| 2,678,045 | A | 5/1954 | Erhard |
| 3,038,067 | A | 6/1962 | Dench et al. |
| 3,161,295 | A | 12/1964 | Chesley |
| 3,308,961 | A | 3/1967 | Chesley |
| 3,452,899 | A | 7/1969 | Libberton |
| 3,751,129 | A | 8/1973 | Wright et al. |
| 3,814,490 | A | 6/1974 | Dean et al. |
| 3,868,021 | A | 2/1975 | Heinrich |
| 4,042,096 | A | 8/1977 | Smith |
| 4,106,668 | A | 8/1978 | Gebhardt et al. |
| 4,269,326 | A | 5/1981 | Delbrouck |
| 4,303,162 | A | 12/1981 | Suttles |
| 4,351,439 | A | 9/1982 | Taylor |
| 4,378,872 | A | 4/1983 | Brown |
| 4,488,653 | A | 12/1984 | Belokin |
| 4,615,276 | A | 10/1986 | Garabedian |
| 4,724,968 | A | 2/1988 | Wombacher |
| 4,730,741 | A | 3/1988 | Jackle, III et al. |
| 4,762,236 | A | 8/1988 | Jackle, III et al. |
| 4,775,058 | A | 10/1988 | Yatsko |
| 4,830,201 | A | 5/1989 | Breslow |
| 4,907,707 | A | 3/1990 | Crum |
| 5,111,942 | A | 5/1992 | Bernardin |

(Continued)

FOREIGN PATENT DOCUMENTS

| | | |
|---|---|---|
| CH | 412251 | 4/1966 |

(Continued)

OTHER PUBLICATIONS

FFr Yellow Pages® 2003 Product Catalog, "Merchandising Ideas Made Easy For Every Retail Environment!", Cover pg., 9-11, 48-49, 52-58, Back Cover.

*Primary Examiner* — Jennifer E. Novosad
(74) *Attorney, Agent, or Firm* — Fay Sharpe LLP

(57) ABSTRACT

A merchandising system includes an elongated mounting member selectively securable to a front portion of an associated shelf. A track is received on the mounting member, wherein the track extends rearwardly over the associated shelf. The track includes an elongated body which is substantially solid in cross section both along a longitudinal axis of the body and in a direction approximately transverse to the longitudinal axis. A first rail extends from the body and, a second rail extends from the body. The second rail is spaced from the first rail.

21 Claims, 12 Drawing Sheets

U.S. PATENT DOCUMENTS

| | | | | |
|---|---|---|---|---|
| 5,161,704 | A | 11/1992 | Valiulis | |
| 5,190,186 | A | 3/1993 | Yablans et al. | |
| 5,203,463 | A | 4/1993 | Gold | |
| 5,255,802 | A | 10/1993 | Krinke et al. | |
| 5,341,945 | A | 8/1994 | Gibson | |
| 5,351,839 | A | 10/1994 | Beeler et al. | |
| 5,390,802 | A * | 2/1995 | Pappagallo et al. | 211/59.3 |
| 5,450,969 | A | 9/1995 | Johnson et al. | |
| 5,469,976 | A | 11/1995 | Burchell | |
| 5,562,217 | A | 10/1996 | Salverson et al. | |
| 5,634,564 | A | 6/1997 | Spamer et al. | |
| 5,638,963 | A * | 6/1997 | Finnelly et al. | 211/59.3 |
| 5,665,304 | A | 9/1997 | Heinen et al. | |
| 5,673,801 | A | 10/1997 | Markson | |
| 5,746,328 | A | 5/1998 | Beeler et al. | |
| 5,839,588 | A | 11/1998 | Hawkinson | |
| 6,041,720 | A | 3/2000 | Hardy | |
| 6,082,557 | A | 7/2000 | Leahy | |
| 6,129,218 | A | 10/2000 | Henry et al. | |
| 6,142,317 | A | 11/2000 | Merl | |
| 6,227,385 | B1 | 5/2001 | Nickerson | |
| 6,234,328 | B1 | 5/2001 | Mason | |
| D445,615 | S | 7/2001 | Burke | |
| 6,382,431 | B1 | 5/2002 | Burke | |
| 6,409,027 | B1 | 6/2002 | Chang et al. | |
| 6,409,028 | B2 | 6/2002 | Nickerson | |
| 6,464,089 | B1 | 10/2002 | Rankin, VI | |
| 6,484,891 | B2 | 11/2002 | Burke | |
| 6,523,703 | B1 * | 2/2003 | Robertson | 211/59.3 |
| 6,527,127 | B2 | 3/2003 | Dumontet | |
| 6,533,131 | B2 | 3/2003 | Bada | |
| D472,411 | S | 4/2003 | Burke | |
| 6,622,874 | B1 | 9/2003 | Hawkinson | |
| 6,655,536 | B2 | 12/2003 | Jo et al. | |
| 6,666,533 | B1 | 12/2003 | Stavros | |
| D485,699 | S | 1/2004 | Mueller et al. | |
| 6,772,888 | B2 | 8/2004 | Burke | |
| 7,201,281 | B1 * | 4/2007 | Welker | 211/59.3 |
| 7,216,770 | B2 * | 5/2007 | Mueller et al. | 211/59.3 |
| 7,497,342 | B2 * | 3/2009 | Hardy | 211/59.3 |
| 2001/0002659 | A1 | 6/2001 | Bada | |
| 2001/0010302 | A1 | 8/2001 | Nickerson | |
| 2002/0108916 | A1 | 8/2002 | Nickerson | |
| 2002/0170866 | A1 | 11/2002 | Johnson et al. | |
| 2003/0057167 | A1 | 3/2003 | Johnson et al. | |
| 2003/0085187 | A1 | 5/2003 | Johnson et al. | |
| 2003/0141265 | A1 | 7/2003 | Jo et al. | |
| 2003/0217980 | A1 | 11/2003 | Johnson et al. | |
| 2004/0118794 | A1 * | 6/2004 | Hardy | 211/59.3 |
| 2004/0245197 | A1 * | 12/2004 | McElvaney | 211/184 |
| 2005/0077260 | A1 * | 4/2005 | Mueller et al. | 211/59.3 |
| 2005/0092703 | A1 * | 5/2005 | Mueller et al. | 211/59.3 |
| 2006/0021957 | A1 * | 2/2006 | Hardy | 211/59.3 |
| 2006/0049122 | A1 * | 3/2006 | Mueller et al. | 211/59.3 |
| 2006/0186064 | A1 * | 8/2006 | Merit et al. | 211/59.3 |
| 2006/0201897 | A1 * | 9/2006 | Mueller et al. | 211/59.3 |
| 2007/0090068 | A1 * | 4/2007 | Hardy | 211/59.3 |
| 2007/0138114 | A1 * | 6/2007 | Dumontet | 211/59.3 |
| 2007/0151938 | A1 * | 7/2007 | Burke | 211/59.3 |
| 2007/0158281 | A1 * | 7/2007 | Hardy | 211/59.3 |
| 2007/0256992 | A1 * | 11/2007 | Olson | 211/59.3 |
| 2007/0267367 | A1 * | 11/2007 | Mueller et al. | 211/59.3 |
| 2008/0017598 | A1 * | 1/2008 | Rataiczak et al. | 211/59.3 |
| 2008/0156752 | A1 * | 7/2008 | Bryson et al. | 211/59.3 |

FOREIGN PATENT DOCUMENTS

| | | |
|---|---|---|
| DE | 28 25 724 | 12/1979 |
| EP | 270016 | 6/1988 |
| EP | 0 337 340 | 10/1989 |
| EP | 986980 | 3/2000 |
| FR | 2 526 338 | 5/1982 |
| FR | 2617385 | 1/1989 |
| FR | 2 724 098 | 3/1996 |
| GB | 2 027 339 | 2/1980 |
| GB | 2290077 | 12/1995 |
| JP | 59-218-113 | 12/1984 |
| WO | WO 02/091885 | 11/2002 |

* cited by examiner

MERCHANDISING SYSTEM

FIELD OF THE INVENTION

The present invention generally relates to adjustable shelving systems. More particularly, the present invention to an adjustable shelving system for storing and displaying merchandise of a variety of shapes and sizes, and urging such merchandise towards the front of a shelf. The shelving system is configured to organize merchandise on the shelf into rows.

BACKGROUND OF THE INVENTION

Shelving is used extensively for stocking and storing products or merchandise in a variety of stores. Many stores simply employ shelves on which merchandise is stocked. In such stores, if the shelves are not at eye level, it is difficult for the customer to see the items being displayed, if they are not located adjacent the front edge of the shelf. It is desirable for merchandise to be displayed at the front of the shelf so that the customer can see the merchandise and be induced to purchase such merchandise. Also, such shelves make it difficult to rotate product, i.e., move the older stock to the front of the shelf and position newer stock behind the older stock. Rotating products is an important consideration, if the goods are perishable or are subject to becoming stale.

Numerous forward feed devices have been proposed to automatically move an item forward on a shelf, as the item before it is removed. These devices generally fall into one of three categories. The first category includes inclined tracks, which rely on gravity to feed, slide or roll products forward. A second category employs conveyor belts, which still use gravity to effect forward movement. A third category, which has become popular in recent years, uses spring biased paddles, in a pusher system to feed the product forward on a horizontally oriented shelf. Such pusher systems have been found useful for a variety of merchandise.

Forward feed devices are usually associated with divider walls. Normally, a divider wall is located on either side of a pusher, mounted on a track, (i.e., a pusher system), so as to maintain the merchandise in rows. In certain designs, both the pusher system and the divider wall are mounted to at least a front rail or front mounting member of the merchandising system, in order to allow a proper spacing of the pusher tracks and the divider walls on a shelf. In some known systems, the divider walls are separate from the pusher tracks. In others, the divider walls and the pusher tracks are of one piece. In either case, the divider walls and pusher tracks are, in some designs, slidably mounted on the front rail or mounting member. In other designs, one or both are fixedly mounted in relation to the front rail. In still other designs, both a front rail and a rear rail are employed and one or both of the pusher tracks and the divider walls are either fixedly secured to one or both of the front rail and the rear rail, or slidably mounted thereon.

Problems remain, however, with both the forward feed devices and the divider walls. As to the forward feed devices, almost universally today these are made from some type of plastic in an injection molding operation. However, the moldings are fairly complex and, thus, the die to make them is complicated and expensive. It would be desirable to develop a track of a simple design which would be easier to mold and yet have sufficient rigidity to resist the stresses and strains imposed on the track during use. With regard to the divider walls, these are normally of a single width. That width, however, may be too wide for certain thin merchandise items offered for sale, such as a row of tooth brushes or small bottles of paint for model kits, such as cars, airplanes, boats and the like. Accordingly, it has been considered desirable to develop a new and improved merchandising system which would overcome the foregoing difficulties and others, while providing better and more advantageous overall results.

SUMMARY OF THE INVENTION

According to one aspect of the present invention, a merchandising system comprises an elongated mounting member selectively securable to a front portion of an associated shelf. A track is received on the mounting member and extends rearwardly over the associated shelf. The track includes an elongated body which is substantially solid in cross section both along a longitudinal axis of said body and in a direction approximately transverse to the longitudinal axis. A first rail extends from the body and a second rail extends from the body. The second rail is spaced from the first rail.

According to another aspect of the present invention, a merchandising assembly is provided. In accordance with this aspect of the invention, the assembly comprises a pusher track comprising an elongated body. A head portion is located at a forward end of the body. A first rail extends from the body and a second rail extends from the body in a manner spaced from the first rail. A pusher is selectively mounted on the body so as to engage the first and second rails. The head of the body is at least as wide in cross section as is a cross section taken through the track, along a line at a location where the pusher is positioned on the track.

In accordance with a further aspect of the present invention, a merchandising system for a shelf is provided. In accordance with this aspect of the invention, an elongated mounting member is selectively securable to a front portion of an associated shelf. A divider is selectively mounted on the elongated mounting member, wherein the divider extends rearwardly over the associated shelf. The divider comprises a base and a wing extending from one side of the base. The wing can be broken away from the base along a break line which extends longitudinally, parallel to the longitudinal axis of the divider.

BRIEF DESCRIPTION OF THE DRAWINGS

The present invention may take form in certain parts and arrangements of parts, several embodiments of which will be described in detail in this specification and illustrated in the accompanying drawings which form a part hereof and wherein.

DETAILED DESCRIPTION OF THE PREFERRED EMBODIMENTS

Figure 1:
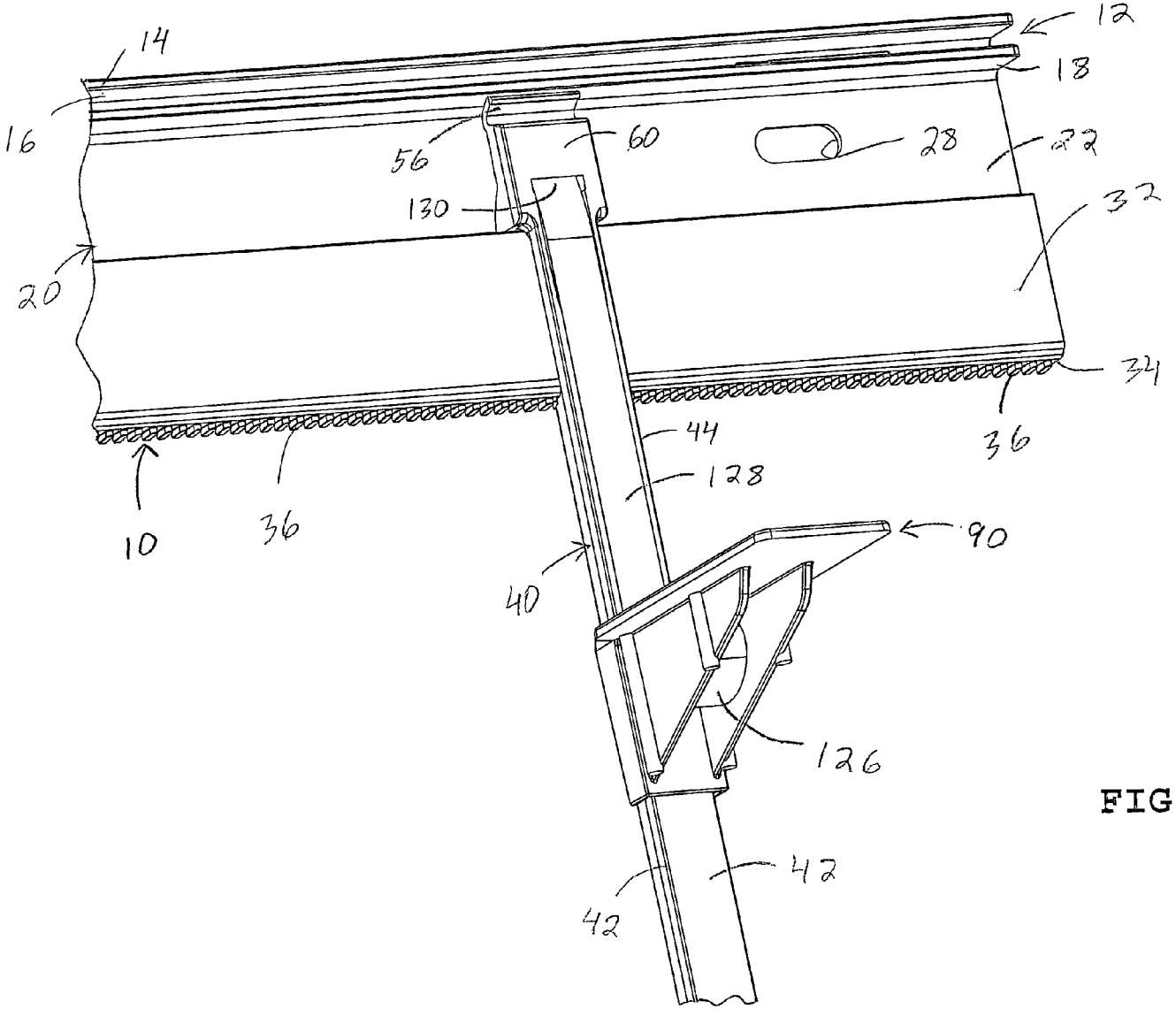
FIG. 1 is a rear perspective view of a merchandising system including a track mounted on a front rail, in accordance with a first embodiment of the present invention.

Referring now to the drawings, wherein the showings are for purposes of illustrating several preferred embodiments of the invention only, and not for purposes of limiting same, FIG. 1 illustrates a first embodiment of a merchandising system according to the present invention. In this embodiment, a mounting member or front rail 10 includes a vertically oriented wall 12, which comprises a first section 14, a groove 16 and a second section 18. Also provided on the mounting member 10 is a horizontally oriented wall 20. Disposed in the horizontally oriented wall is a second groove 22. An aperture 28, positioned in the second groove 22, extends through the horizontally oriented wall 20. A suitable conventional fastener (not illustrated) can extend through the opening 28 so as to secure the mounting member in place on a subjacent shelf (not illustrated). Such a construction is shown in applicant's previously filed application Ser. No. 10/686,096 which is dated Oct. 14, 2003. That application is incorporated herein by reference, in its entirety. Moreover, applicant has also filed a related case, application Ser. No. 10/854,991 which is dated May 27, 2004. That application is also incorporated herein by reference, in its entirety.

As mentioned, the horizontally oriented wall 20 comprises the second groove 22, and a plateau-like section which includes a front face 30, a top face 32 and a back face 34. Located on the back face are a plurality of spaced teeth 36.

Figure 8:
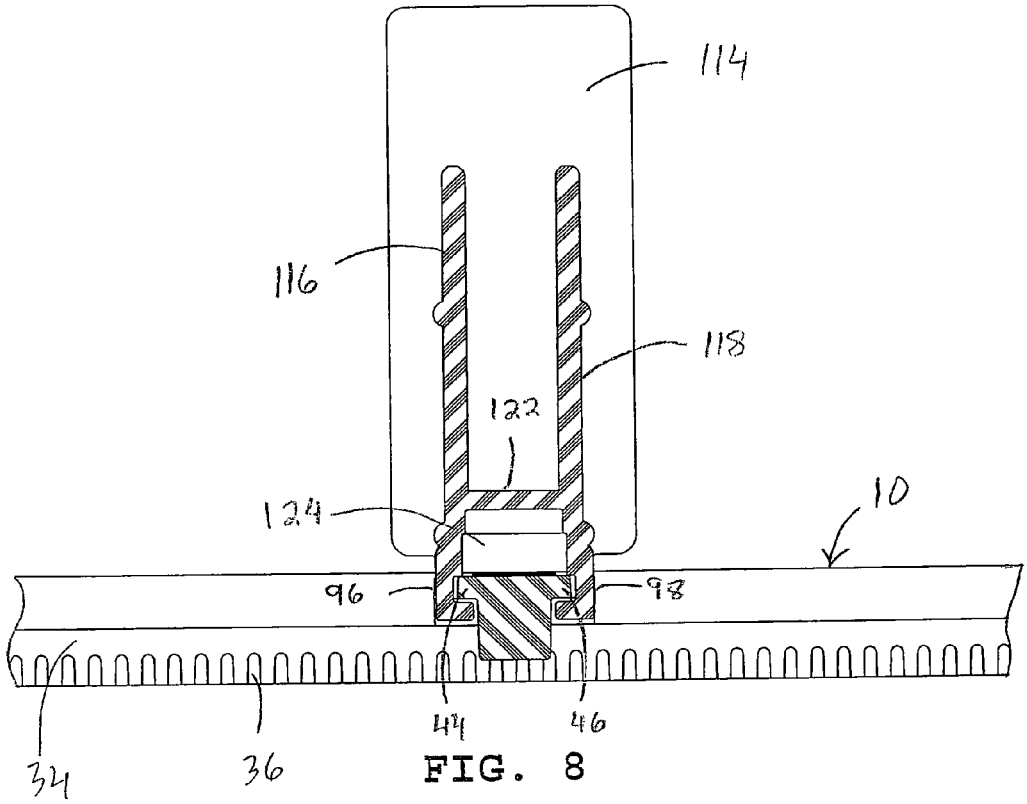
FIG. 8 is a rear elevational view, in partial cross section, of the merchandising system of FIG. 1.

A pusher track 40 is selectively mounted on the front rail 10. The track 40 includes an elongated track body 42. Defined on the track body in this embodiment are a pair of oppositely extending rails 44 and 46. As is evident from FIG. 8, the track body 42 is solid in cross section. As can also be seen from the cross sectional view of FIG. 9, the track is solid in longitudinal section, along a longitudinal axis thereof. Having a solid rail is advantageous for a number of reasons. First, it makes the molding process for making the rail—from a suitable known thermoplastic material—easier than molding conventional tracks, which require a more complicated die. In addition, because the track is solid, rather than being hollow with cross braces, it can be made from a less expensive thermoplastic material than used for conventional tracks. Conventional track designs require a more rigid and hence more expensive thermoplastic material.

If desired, the track can be made via a gas-assisted injection molding process, in which a certain proportion of the thermoplastic material of the track is replaced by gas. Since less material is used, the cost of the track is reduced somewhat. Such a process allows the part to be somewhat lighter, while still preserving its inherent strength. With this design, the track also has a relatively lower coefficient of friction. The coefficient of friction of such a track is reduced somewhat because of the more porous track surface resulting from the gas-assisted injection molding process. With a more porous surface, there is less surface contact between the track on the one hand and merchandise or a pusher paddle on the other hand. Thus, merchandise supported by the track can more easily slide on the track, as can a pusher paddle.

Figure 3:
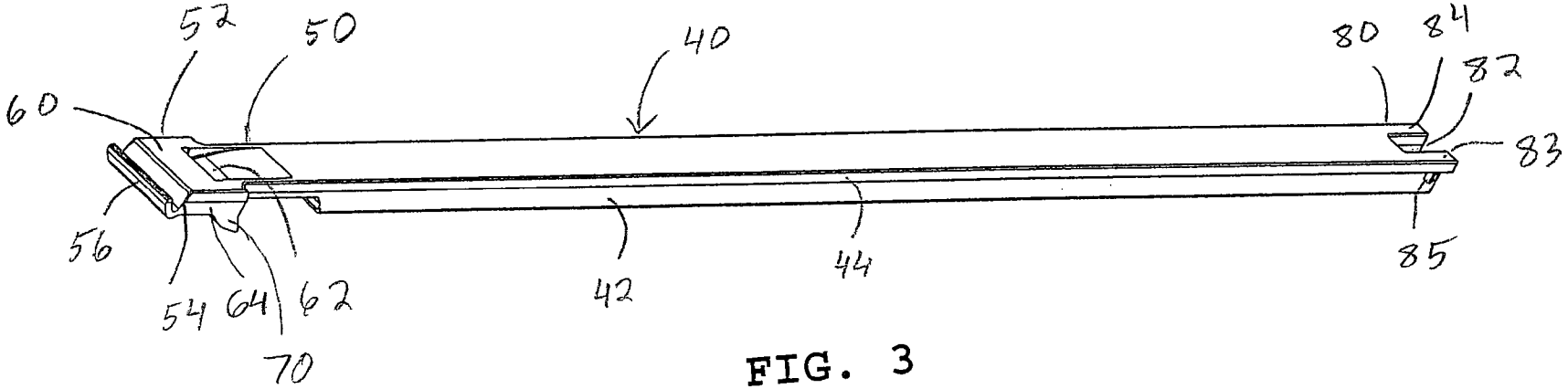
FIG. 3 is a top side perspective view of the track of FIG. 1.

With reference now to FIG. 3, the track includes a front end 50, which comprises a mounting head 52. The mounting head includes a front face 54. Protruding from the front face is a forwardly extending lip 56. As best seen in FIG. 1, the lip 56 is meant to engage the second section 18 of the front rail vertically oriented wall so as to correctly locate or position the track on the front rail and prevent any looseness or wobbling in the engagement between the track and the front rail.

Figure 4:
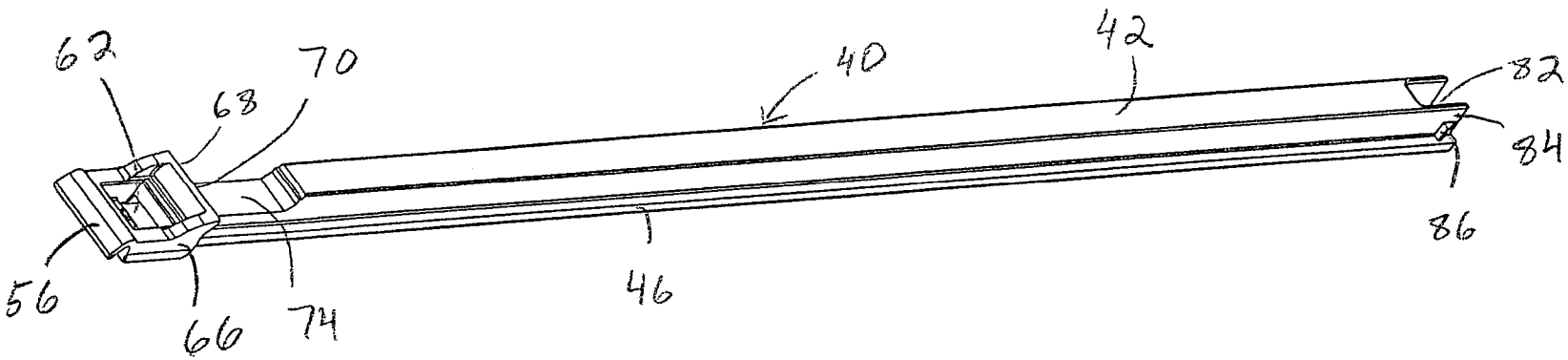
FIG. 4 is a bottom side perspective view of the track of FIG. 1.

The mounting head 52 also includes a top face 60. An aperture 62 extends through the top face, as is evident from a comparison of FIGS. 3 and 4. The mounting head also includes a first side wall 64, a second side wall 66 and a rear wall 68. Depending from the rear wall is a projection 70. Located in the pusher track 40 behind the mounting head 52 is a cross slot 74, as best seen in FIG. 4. The cross slot is meant to accommodate the plateau-like portion of the front rail, as is evident from FIGS. 1 and 2.

With reference again to FIG. 3, the pusher track includes a rear end 80. Extending through the rear end is a vertically oriented slot 82. The slot 82 thus divides the track rear end into two portions or defines extensions 83 and 84. Such extensions allow the track rear end to be flexible, in relation to the remainder of the track. Located on opposed side faces of the track body 42, adjacent the slot 82, are first and second teeth 85 and 86. The teeth can be located directly beneath the first and second rails 44 and 46.

Figure 5:
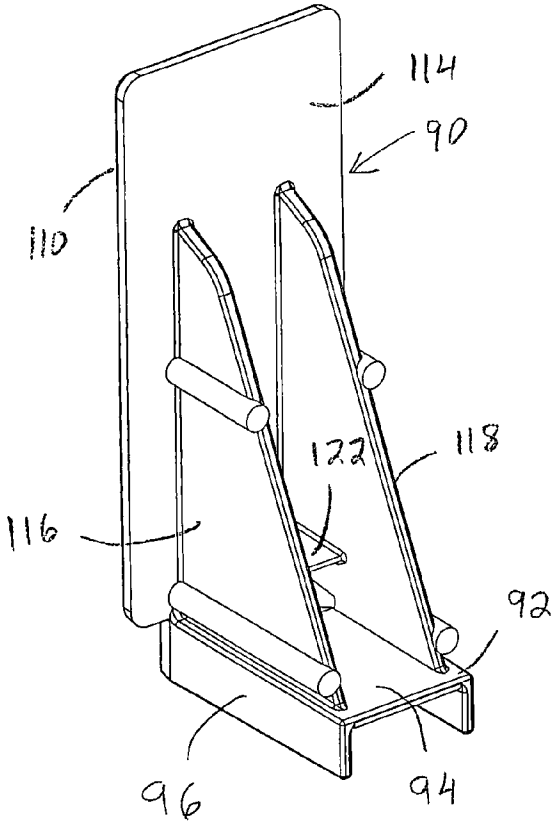
FIG. 5 is an enlarged rear perspective view of a pusher mounted on the track of FIG. 1.
Figure 6:
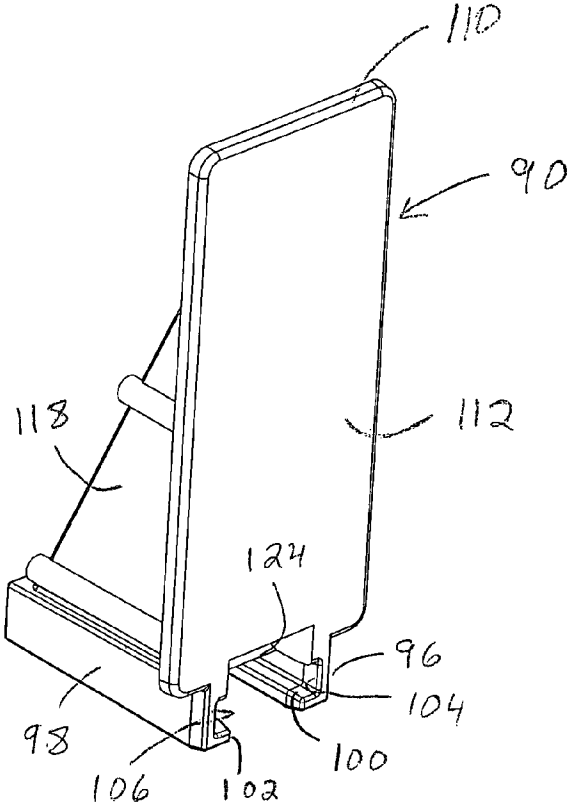
FIG. 6 is a front perspective view of the pusher of FIG. 5.
Figure 7:
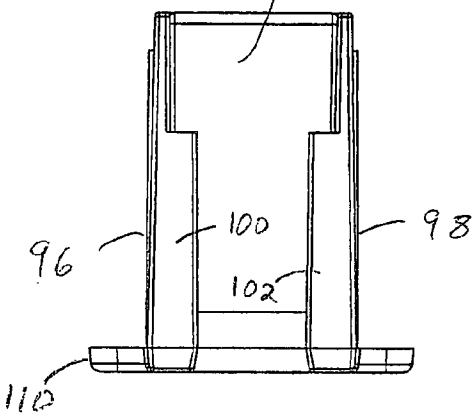
FIG. 7 is a reduced bottom plan view of the pusher of FIG. 5.

With reference now to FIG. 5, a pusher 90 is adapted to be mounted on the pusher track 40. The pusher 90 includes a base 92. The base comprises a top wall 94, a first side wall 96 and a second side wall 98 (FIG. 6). Thus, an inverted channel-like configuration is defined. With reference now also to FIG. 7, a first flange 100 extends from the first side wall 96 and a second flange 102 extends from the second side wall 98. With reference to FIG. 6, a first groove 104 is defined in the first side wall 96 and the second groove 106 is defined in the second side wall.

Figure 9:
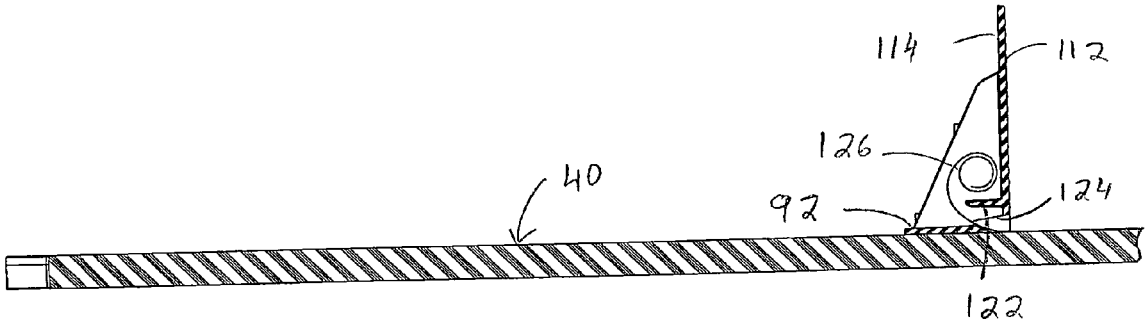
FIG. 9 is a reduced side elevational view, in cross section, of the merchandising system of FIG. 1.

A paddle 110 is mounted on the base 92. FIG. 6 shows that the paddle includes a front face 112. With reference again to FIG. 5, the paddle also includes a rear face 114. Supporting the rear face are first and second gussets 116 and 118, which extend from the paddle rear face to the base top wall 94. The gussets reinforce the pusher 90 and prevent the paddle 110 from buckling. A support wall 122 is disposed between the pair of gussets, in a manner spaced from the pusher base top wall 94. With reference now to FIG. 9, a suitable coil spring 126 is mounted on the support wall 122. As best shown in FIG. 1, the coil spring has a front portion 128 and a front end 130. The coil spring front end includes a bent portion (not visible) which extends into the aperture 62 in the pusher track and engages the track to retain the spring in place. This is conventional in the art.

When merchandise (not illustrated) is placed on the track 40 as in FIG. 1, the merchandise sits on the forward portion 128 of the coil spring. The spring, since it is made from a suitable conventional metal, is inherently somewhat more slippery than the material of the track. Since the coil spring sits directly on the track, the merchandise sits on the coil spring and, thus, can slide more easily than if it sat directly on the track. In another embodiment, ribs (not shown) could be provided laterally on both sides of the coil spring so as to further reduce frictional contact between the track and merchandise supported on the track.

In order to mount the pusher 90 on the pusher track 40, the two portions or extensions 83 and 84 of the track body rear end 80 are pushed towards each other. Due to the resilient and flexible nature of the thermoplastic material from which the track body is made, and due to the presence of the vertical slot 82, a width of the track rear end can be reduced so as to allow the pusher base to be mounted on the pusher track. Once the pusher is mounted, the rear end portions 83 and 84 return to their normal orientation because of the inherent resiliency of the material from which the track is made. When so mounted, the first and second rails 44 and 46 of the pusher track are accommodated in the first and second grooves 104 and 106 defined in the base 92 of the pusher 90. Therefore, the pusher 90 is allowed to reciprocate on the track 40. Also, the pusher is urged in a forward direction by the coil spring 126.

The teeth 85 and 86 at the rear end of the pusher track 40 prevent the pusher 90 from sliding off the track at the rear end thereof. More particularly, the side walls 96 and 98 of the pusher engage the teeth 85 and 86 to prevent the pusher from being slid off the track. However, in case the pusher needs to be removed, a merchant simply needs to press the two portions 83 and 84 of the track rear end towards each other so as to allow the pusher to clear the teeth. In order to prevent the pusher from sliding off the forward end of the track, it is apparent from, e.g., FIG. 1, that the pusher track mounting head 52 is larger in width than is the remainder of the pusher track. This serves several purposes.

First, it prevents the pusher from sliding off the track in a forward direction. Secondly, the wider mounting head 52 on the pusher track 40 prevents engagement between adjacent pushers mounted on adjacent tracks. Such engagement is disadvantageous as it would retard the ability of the pusher to slide forward and rearward on the track. Thus, the relative width of the mounting head 60 is such that it is at least as wide as a cross section taken through the pusher track and the pusher, at the location of the pusher 90. This cross sectional relationship prevents the pusher from getting hung up on an adjacent pusher track or being inadvertently moved, when it is located next to another pusher on an adjacent pusher track.

Figure 10:
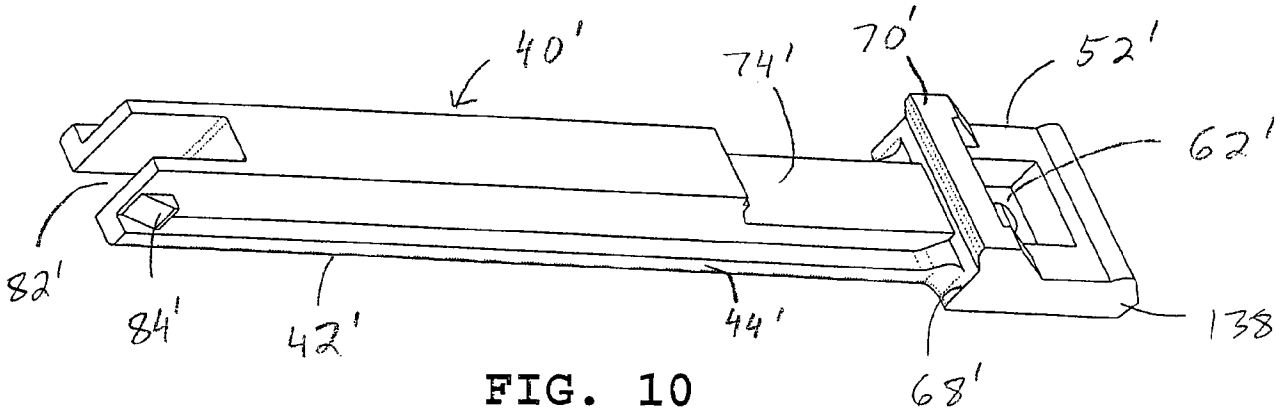
FIG. 10 is a bottom perspective view of a pusher track according to a second embodiment of the present invention.
Figure 11:
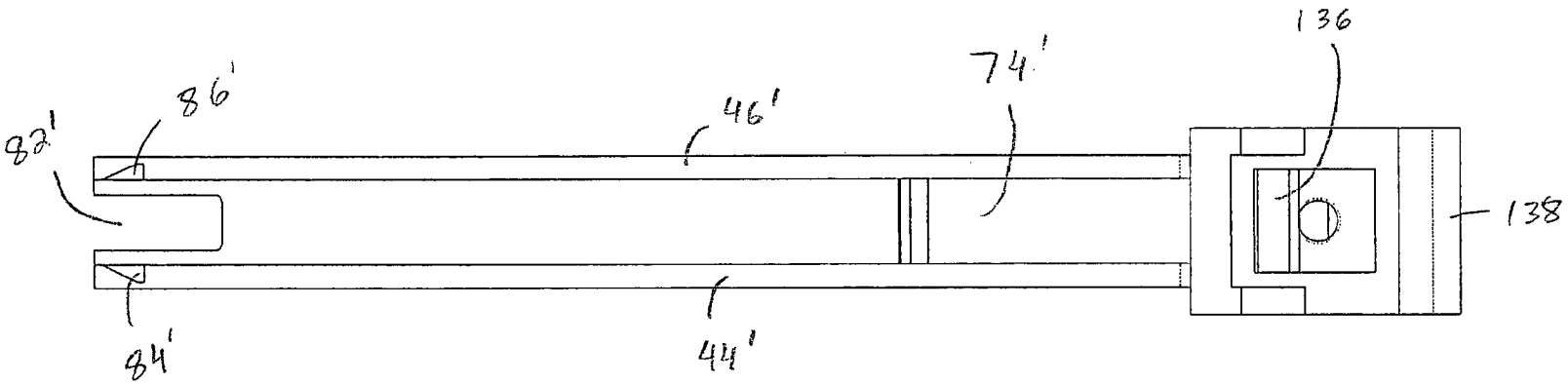
FIG. 11 is an enlarged bottom plan view of the pusher track of FIG. 10.

With reference now to FIG. 10, a second embodiment of a pusher track is there illustrated. In this embodiment, like components are identified by like numerals with a primed (') suffix and new components are identified by new numerals. In this embodiment, a pusher track 40' includes a track body 42' with first and second rails 44' and 46'. Also provided is a mounting head 52'. Extending through the mounting head is an aperture 62'. Located on a rear wall 68' of the mounting head is a projection 70'. A cross slot 74' extends across the track body 42' behind the mounting head 52'. A rear end of the pusher track 40' includes a vertical slot 82', as well as first and second teeth 84' and 86'. In this embodiment, a tongue 136 can be seen as being defined in the mounting head, adjacent the aperture 62'. The tongue is meant to engage the front end of a coil spring (not shown). Also, a contact surface 138 is provided at the front end of the mounting head. Such a contact surface may be sufficient in certain circumstances, not calling for an engaging lip, such as the one illustrated in FIG. 1.

It can be seen that the track 40' illustrated in FIG. 10 is relatively shorter than the track 40 illustrated in FIG. 3. It should be appreciated that the length of a track according to the present invention can be suitably sized so as to be accommodated on a shelf of a particular depth. Some merchandising systems have relatively deep shelves and others have relatively shallow shelves. Tracks can be manufactured to accommodate such disparities in shelving depths.

Figure 12:
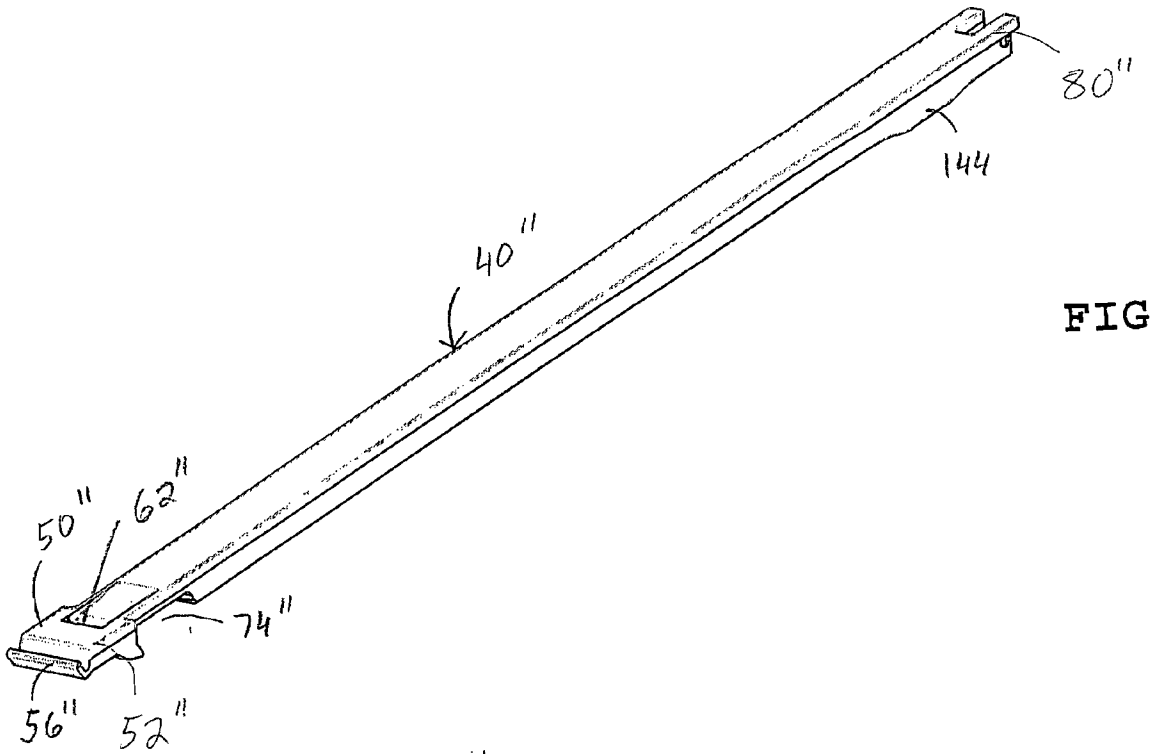
FIG. 12 is a top perspective view of a pusher track according to a third embodiment of the present invention.
Figure 13:
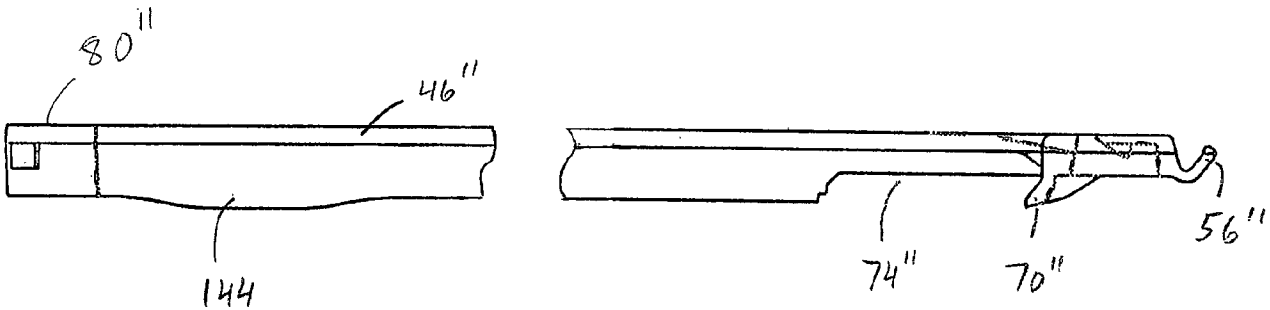
FIG. 13 is an enlarged side elevational view, partially broken away, of the pusher track of FIG. 12.
Figure 15:
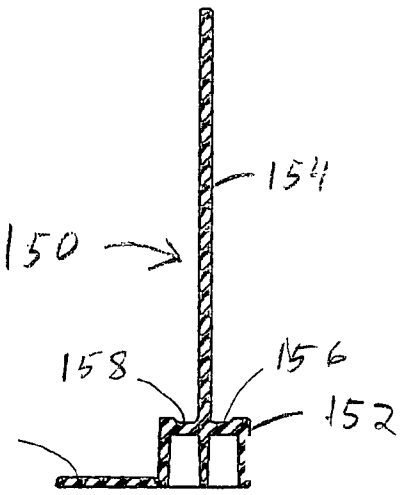
FIG. 15 is a reduced front elevational view, in cross section, of the divider of FIG. 14.

With reference now to FIG. 12, a third embodiment of a pusher track according to the present invention is there illustrated. For ease of comprehension, like components in this embodiment are identified by like numerals with a double primed (") suffix and new components are identified by new numerals. A pusher track 40" includes a front end 50" which comprises a mounting head 52". An engaging lip 56" is defined on a front face of the mounting head. Also, a cross slot 74" extends across a bottom face of the pusher track 40". As is best illustrated in FIG. 13, the pusher track comprises a thickened section 144, which is located near a rear end 80" thereof. The thickened section serves to prevent any tipping motion of the track in relation to the front rail. In this way, the track remains stable as product is placed on or taken off the track, in front of a pusher paddle (not shown for this embodiment), mounted for reciprocation on the track.

Figure 14:
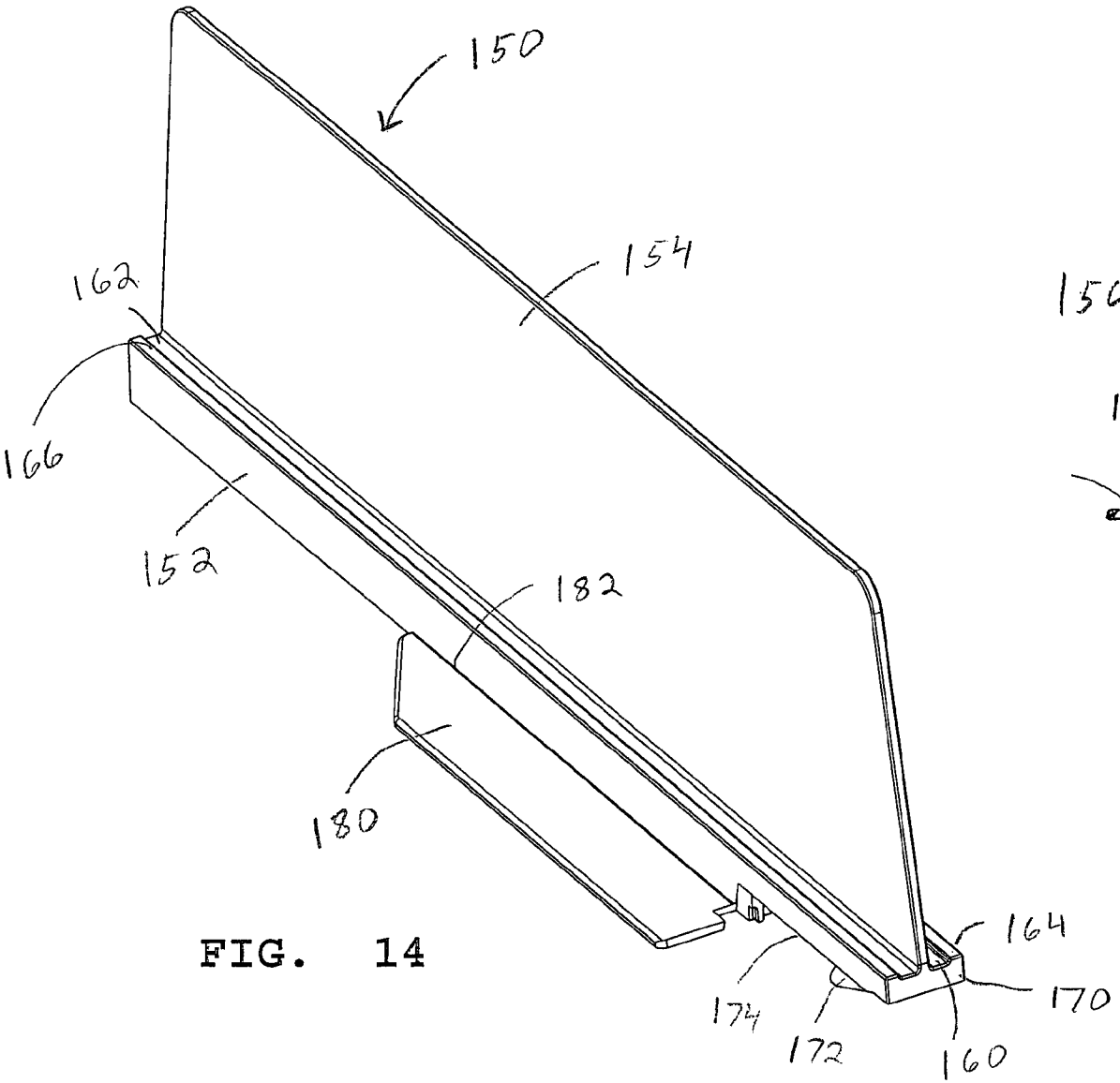
FIG. 14 is a perspective view of a divider according to a first embodiment of the present invention for use with the merchandising system of FIG. 1.

With reference now to FIG. 14, a divider 150 according to one embodiment of the present invention is there illustrated. The divider is meant to be accommodated on the front rail shown in FIG. 1. The divider includes a base 152. An upright wall 154 protrudes from the base. The upright wall separates the base into a first section 156 and a second section 158. Defined on each section is a respective groove 160 and 162 and a respective rail 164 and 166. The first and second sections 156 and 158 of the base 152 can support side edges of merchandise. One purpose for providing rails 164 and 166 and grooves 160 and 162 on the base 152 is to reduce friction as the goods slide in relation to the base of the divider, as urged by the pusher. Located adjacent a front end 170 of the divider base 152 is a projection 172. Located rearwardly of the projection is a cross slot 174. The cross slot is meant to accommodate the plateau-like raised section of the front rail horizontally oriented wall.

In this embodiment, a side wing 180 is located on one side of the base 152. However, for narrow products, such as, e.g., a row of tooth brushes or small bottles of paint used for painting model kits, such as model cars or model airplanes, the wing 180 can be broken off from the divider base, along a break line or weakened line 182. In this way, the divider can be made narrower when that is necessary. Thus, two dividers can be spaced closely from each other, with a track therebetween, so as to accommodate narrow merchandise. On the other hand, if that is not necessary, the divider can include the wing 180. It is evident from FIG. 14 that the break line 182 extends parallel to a longitudinal axis of the divider 150.

With reference again briefly to the pusher track illustrated in FIGS. 12 and 13, the thickened section 144 is located on the pusher track in such a manner as to be positioned rearwardly of the wing 180. In other words, the pusher track can extend over the wing 180 and, yet, the track remains stable on the shelf, and in relation to the front rail, and does not wobble, since it is supported partially by its thickened section and partially by the wing 180 on the divider 150.

It is evident from FIG. 14, that in this embodiment, the wing 180 has a substantially flat front end 184 and a tapered rear end 186. Of course, any other suitable configuration for the front and rear ends of the wing could be used as desired. It is also noted that a small notch 188 is provided on the inboard side of the front end 184 of the wing 180.

Figure 2:
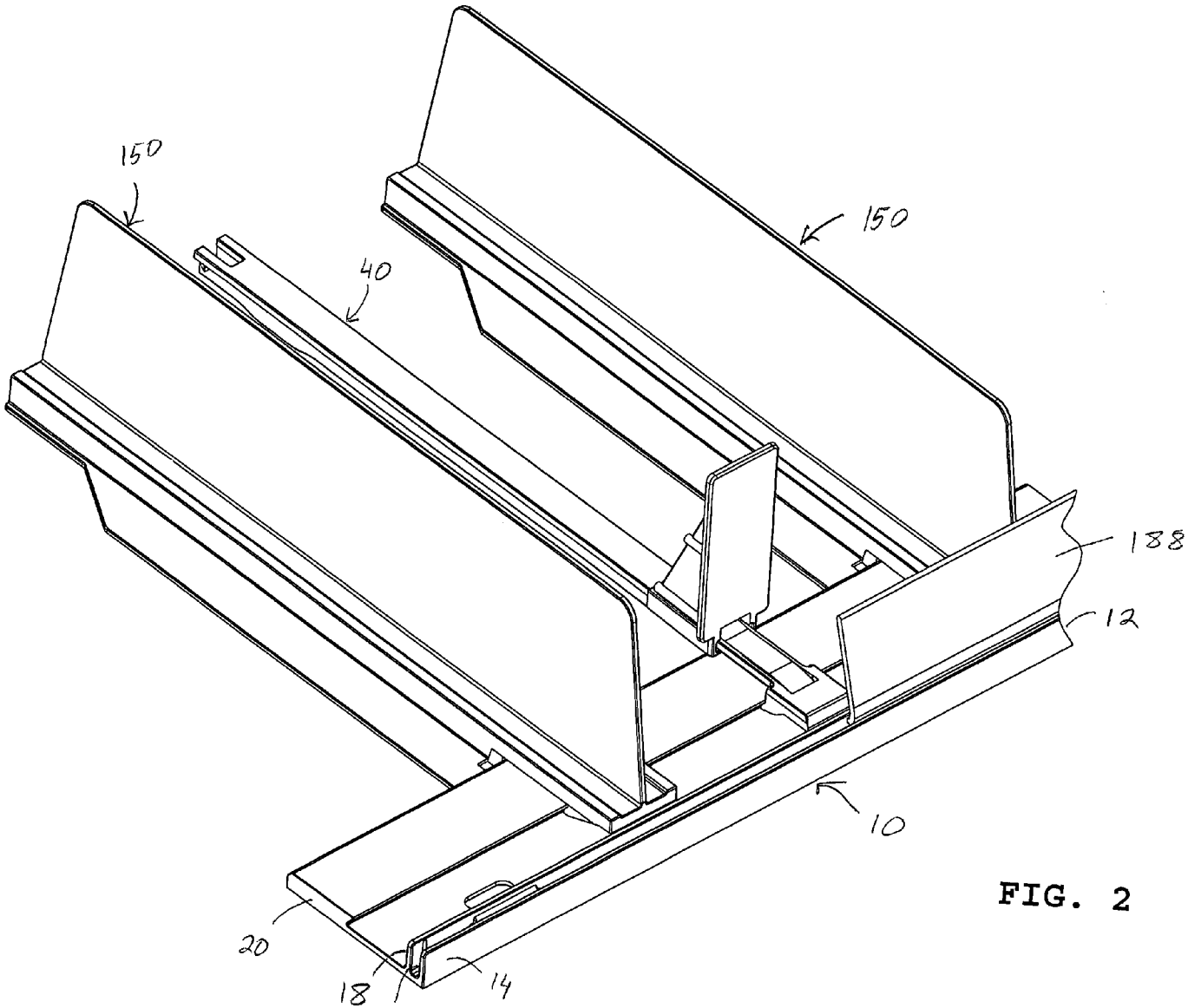
FIG. 2 is a reduced front perspective view of the merchandising system of FIG. 1, also including a pair of dividers and a front fence.

With reference again to FIG. 2, it should be evident that a divider 150 can be mounted to the front rail 10, adjacent the track 40. The flat front end 184 of the wing 180 can contact the rear surface 34 (FIG. 1) of the front track 10. This can aid in positioning the divider in a stable manner on the front rail and can retard a tendency of the divider to pivot in relation to the front rail. Spaced from the divider is a track 40. Located on the other side of the track is a second divider 150. Also illustrated in FIG. 2 is a front fence 188. The front fence can be inserted in the slot 16 located between the first and second sections 14 and 18 of the front rail vertical wall 12. The front fence 188 can be made of a transparent material so that the merchandise being displayed on the shelf (not illustrated) is visible to the customer.

Figure 17:
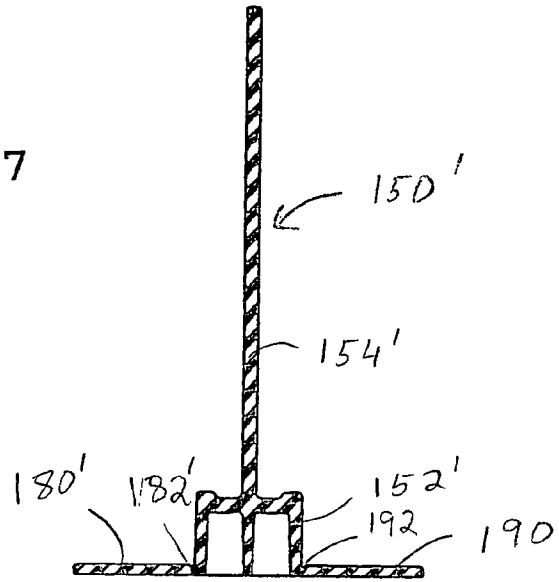
FIG. 17 is a front elevational view, in cross section of the divider of FIG. 16.
Figure 16:
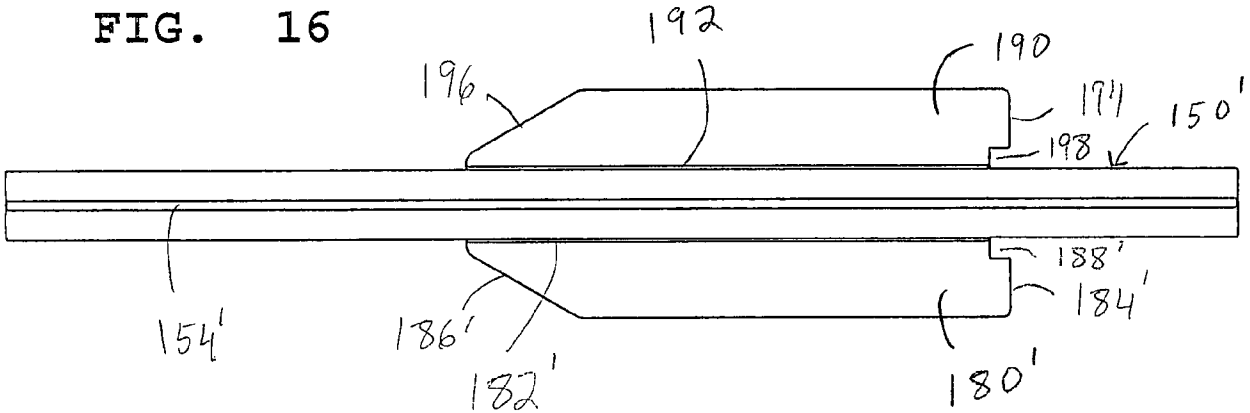
FIG. 16 is a top plan view of a divider according to a second embodiment of the present invention for use with the merchandising system of FIG. 1.

With reference now to FIG. 16, another embodiment of a divider is there illustrated. For ease of comprehension, like components identified by like numerals with a primed (') suffix and new components are identified by new numerals. In this embodiment, a divider 150' includes a base 152' and an upright dividing wall 154'. Located on one side of the base 152' is a first wing 180'. A break line 182' allows the wing 180' to be broken away, when so desired. Located on an opposite side of the base 152' is a second wing 190. A second break line 192 allows the wing 190 to be broken away from the base 152' of the divider 150' when so desired. It is apparent from FIG. 17 that both the first and second wings 180' and 190 can, in this embodiment, be of a significantly lesser thickness than is a thickness of the base 152'.

In this embodiment, both the wings 180' and 190 have a substantially flat front end 184' and 194 and a tapered rear end 186' and 196. It is also noted that a small notch 188', 198 is provided on the inboard sides of the front ends 184' and 194 of both wings. In the embodiments illustrated in FIGS. 14-17, the respective bases 152 and 152' can be seen to comprise a suitable thermoplastic material which can be injection molded so as to have longitudinally extending cavities beneath the top surface of the base 152.

Figure 18:
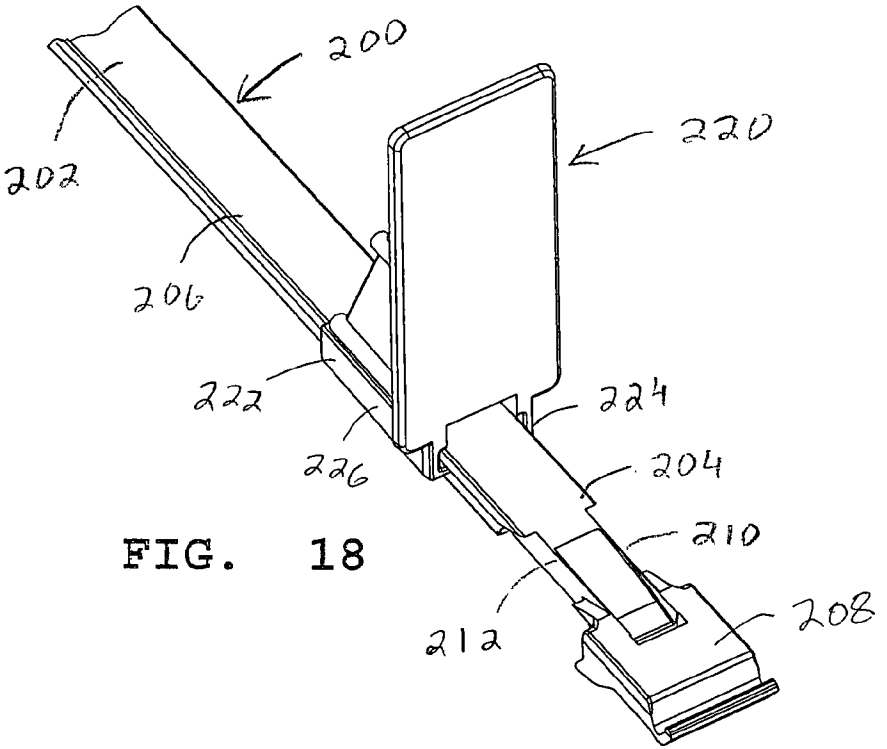
FIG. 18 is a perspective view of a merchandising track and pusher, according to still another embodiment of the present invention.
Figure 19:
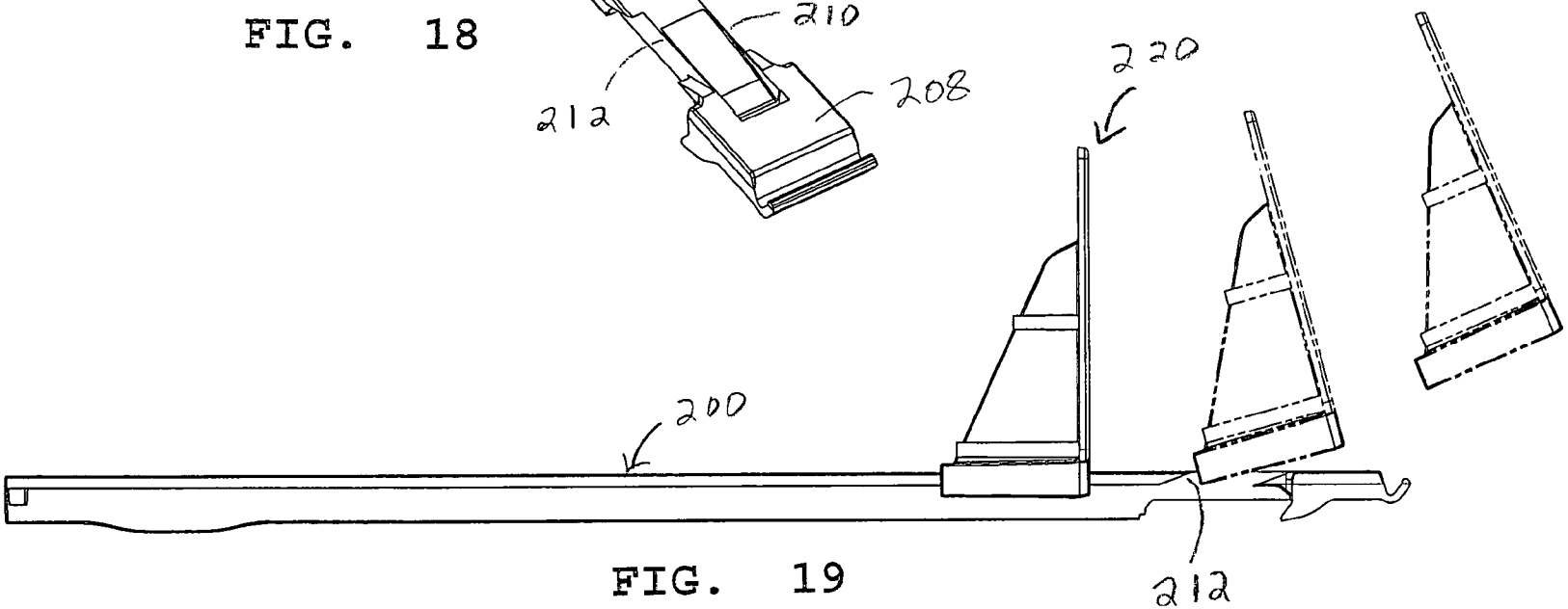
FIG. 19 is a side elevational view of the merchandising track and pusher of FIG. 18.

With reference now to FIG. 18, another pusher track 200 according to a further embodiment of the invention is there illustrated. In this embodiment, the pusher track 200 comprises a track body 202, on which are defined a pair of oppositely extending first and second rails 204 and 206. Located adjacent a head portion 208 of the track body 202 are respective slots 210 and 212, which are defined in the rails 204 and 206, respectively. The purpose for the slots is to allow another way of mounting a pusher 220 to the track 200. As is evident from FIG. 19, in this embodiment, the pusher 220 is slid onto the track via the slots 210 and 212. To this end, the pusher includes a base 222 with a pair of opposite side walls 224 and 226. These side walls engage the rails 204 and 206 of the track 200 after the pusher 220 is mounted on the track.

Figure 20:
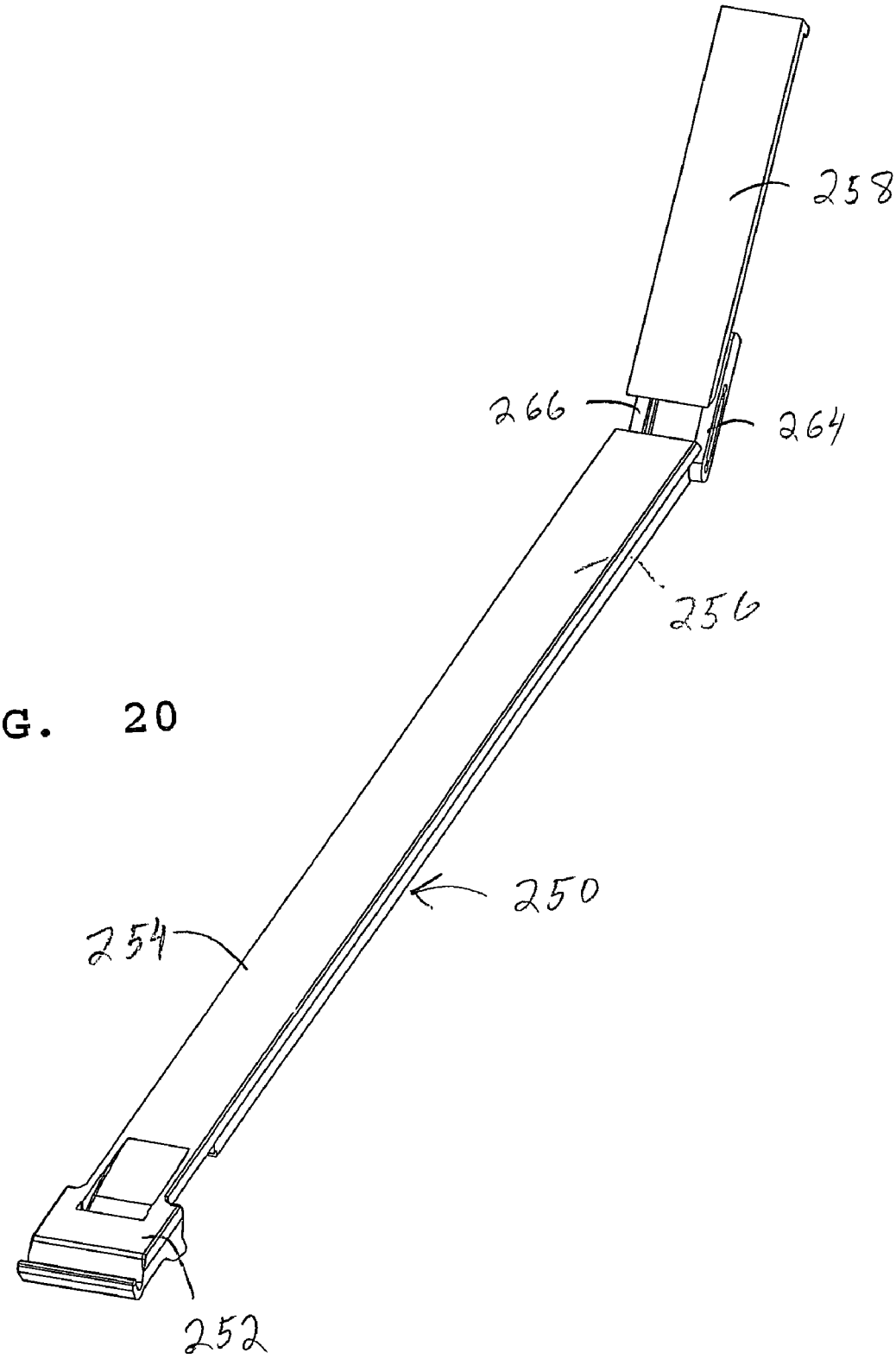
FIG. 20 is a perspective view of a track according to a still further embodiment of the present invention.

FIG. 20 illustrates yet another embodiment of a track according to the present invention. In this embodiment, a track 250 comprises a head portion 252 and a body portion 254. The body portion comprises a first section 256 and a second section 258. The two sections of the body portion are connected by a first link 264, located on one side of the body portion 254, and a second link 266, located on the other side thereof. The two links 264 and 266 can have the same construction.

Figure 22:
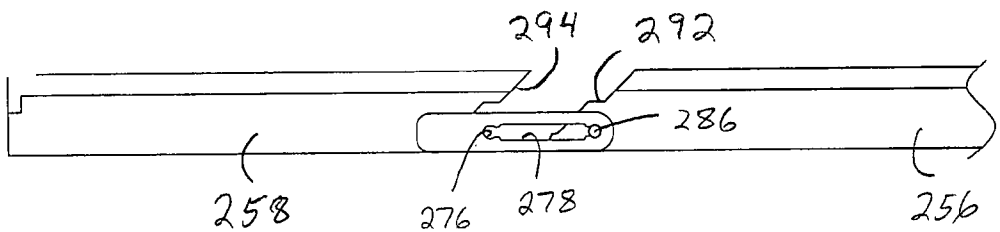
FIG. 22 is a left side elevational view of the track of FIG. 21 is a second orientation; and, FIG. 23 is a left side elevational view of the track of FIG. 21 as moving from the second orientation to a third orientation.
Figure 21:
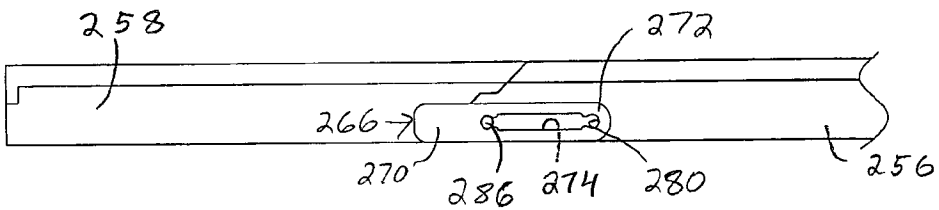
FIG. 21 is an enlarged left side elevational view partially broken away of the track of FIG. 20 in a first orientation.

With reference now to FIG. 21 where only the second link 266 is illustrated, each link includes a first portion 270 and a second portion 272. Defined in the second portion is a slot 274. The link first portion 270 is secured by conventional means to the body portion second section 258. The link second portion 272 is adapted to move in relation to the body portion first section 256, as is evident from a comparison of FIGS. 21-23. More particularly, the slot 274 includes a rear end 276, as best seen in FIG. 22, a central portion 278 and a front end 280, which can be best seen in FIG. 21. Extending into the slot is a stub 286 which is connected to, or is an integral part of, the body portion first section 256. In this way, the stub can move in the slot 274 as the first and second sections 256 and 258 of the body portion are moved in relation to each other. Thus, a hinge construction is formed between the two sections 256 and 258.

More particularly, in FIG. 21, the second section 258 of the body portion 254 is in mating contact with the first section 256 thereof. In contrast, in FIG. 22, the two sections 256 and 258 are separated from each other to the extent allowed by the length of the slot 274. That is, the stub 286 has now moved from the slot rear end 276 to the slot front end 280. At this time, the two sections 256 and 258 of the body portion are now separated. Exposed at this time are a tapered rear face 292 of the first section 256 and a mating tapered front face 294 of the second section 258. Employing tapered mating surfaces is beneficial to retard any possibility for a downward movement of the body portion second section 258 in relation to the first section 256. Sideward movement of the second section 258 is retarded by the links 264 and 266. Upward movement of the second section 256 is only restrained by gravity, in this embodiment. However, it can be appreciated that other types of cooperating mating surfaces could be employed for the body portion first and second sections 256 and 258.

Figure 23:
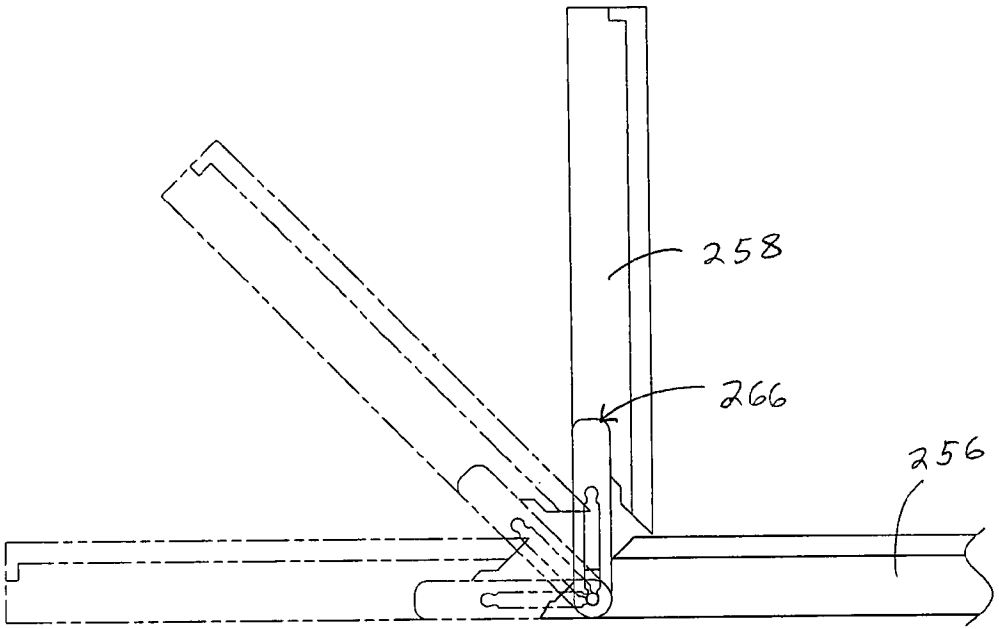

Once the two sections have been spaced from each other, the second section 258 can be rotated in relation to the first section 256, as is illustrated in FIG. 23. In this way, the overall length of the track 250 can be shortened by simply rotating the second section 258 to a vertical position, as is illustrated in FIG. 23. Now, the track can be adapted for a shallower depth shelf, should that become necessary.

While the embodiments disclosed herein illustrate the use of a slot, i.e., a transverse groove or opening for connecting the pusher track 40, 40', 40", 200, 250 and the divider 150, 150' to the front rail 10, it should be appreciated that many other ways of connecting the pusher track and the divider to the rail can also be employed.

The invention has been described with reference to several embodiments. Obviously, modifications and alterations will occur to others upon a reading and understanding of this specification. It is intended to include all such modifications and alterations in so far as they come within the scope of the appended claims or the equivalents thereof.

Having thus described the preferred embodiments, the invention is claimed as follows:

1. A merchandising system comprising:

an elongated mounting member;

a track selectively connected to said mounting member and comprising an elongated monolithic body including a head portion located at a forward end of said body, and a first rail defined on said body;

a pusher selectively mounted on said body so as to engage said first rail, said track configured to support said pusher for movement along the length of the track in a longitudinal direction; and, wherein said head portion of said body is wider in cross section than is a cross section taken through said track, along an axis of said track extending transversely to the longitudinal direction at a location where said pusher is positioned on said track.

2. The merchandising system of claim 1 wherein said track comprises a gas-filled thermoplastic material.

3. The merchandising system of claim 1 wherein said head portion further comprises a tongue, said tongue extending forwardly from said head portion, said tongue contacting a wall of said mounting member to retard relative movement between the mounting member and said track, when said track is mounted on the mounting member.

4. The merchandising system of claim 1 further comprising a coil spring for urging said pusher forwardly on said track wherein a rear portion of said coil spring is accommodated on a support mounted to said pusher.

5. The merchandising system of claim 4 wherein said pusher track head portion comprises an aperture which accommodates a front end of said coil spring.

6. The merchandising system of claim 4 wherein said pusher includes a pusher face and a slot, defined in said pusher face, to allow said coil spring to extend through said slot and forwardly on said pusher track.

7. The merchandising system of claim 1 wherein said track comprises a thickened portion, spaced from said head portion.

8. The merchandising system of claim 1 wherein said track includes a slot which accommodates a portion of said mounting member.

9. The merchandising system of claim 1 further comprising a pusher and wherein said track comprises a vertically oriented slot located in a rear end of said elongated body such that said body defines a pair of extensions, making said rear end of said track flexible, to enable said pusher to be mounted on said track.

10. The merchandising system of claim 9 further comprising at least one protrusion located on a side wall of said track adjacent said longitudinal slot to retard said pusher from sliding off the track.

11. A merchandising system comprising:

an elongated mounting member;

a track selectively connected to said mounting member and comprising an elongated body;

a head portion located at a forward end of said body, said head portion connecting the track to the elongated mounting member;

at least one rail extending from said body;

a pusher selectively mounted on said body so as to engage said at least one rail, said track configured to support said pusher for movement along the length of the track in a longitudinal direction; and, wherein said head portion of said body is wider in cross section than is a cross section taken through said track, along an axis of said track extending transversely to the longitudinal direction at every location where said pusher is mountable on said track.

12. The merchandising system of claim 11 wherein said head portion further comprises a tongue, said tongue extending forwardly from said head portion, said tongue contacting a wall of said mounting member to retard relative movement between the mounting member and said track, when said track is mounted on the mounting member.

13. The merchandising system of claim 11 further comprising a coil spring for urging said pusher forwardly on said track wherein a rear portion of said coil spring is accommodated on a support mounted to said pusher.

14. The merchandising system of claim 13 wherein said pusher track head portion accommodates a front end of said coil spring.

15. The merchandising system of claim 13 wherein said pusher includes a pusher face and a slot, defined in said pusher face, to allow said coil spring to extend through said slot and forwardly on said pusher track.

16. The merchandising system of claim 11 wherein said head portion comprises a depending projection.

17. A merchandising system comprising:

an elongated mounting member selectively securable to a front portion of an associated shelf;

a track received on the mounting member, wherein the track extends rearwardly over the associated shelf, said track comprising:

an elongated monolithic body including a first end, a second end, a top face, a bottom face, a first side wall, and a second side wall, and a longitudinal axis extending from said first end to said second end;

an enlarged section located at said track first end, wherein said enlarged section has a transverse width that is larger measured from said first side wall to said second side wall than is a transverse width of a remainder of said elongated body measured from said first side wall to said second side wall.

18. The merchandising system of claim 17 wherein said elongated body further comprises a thickened portion between the first end and second end.

19. The merchandising system of claim 17 further comprising a pusher mounted on said track, said pusher comprising:

a base;

a pusher face extending from said base; and, a wall which extends from said base engages said track to slidably mount said pusher on said track.

20. The merchandising system of claim 17 further comprising a pusher and wherein said track comprises a vertically oriented slot located in a rear end of said elongated body such that said body defines a pair of extensions, making said second end of said track flexible, to enable said pusher to be mounted on said track.

21. The merchandising system of claim 20 further comprising protrusions located on opposed side walls of said track adjacent said longitudinal slot to retard said pusher from sliding off the track.

* * * * *